United States Patent [19]

Baker

[11] 4,129,260

[45] Dec. 12, 1978

[54] GARBAGE DISPOSAL

[76] Inventor: Marlin J. Baker, 1039 Meadowbrook La., Conyers, Ga. 30207

[21] Appl. No.: 805,820

[22] Filed: Jun. 13, 1977

Related U.S. Application Data

[63] Continuation-in-part of Ser. No. 716,582, Aug. 23, 1976, abandoned.

[51] Int. Cl.[2] ..... B02C 13/04; B02C 13/286

[52] U.S. Cl. ..... 241/46 A; 241/73; 241/88.1; 241/189 R; 241/194

[58] Field of Search ..... 241/46 A, 73, 88.1, 241/88.2, 89.2, 89.3, 188 R, 189 R, 194

[56] References Cited

U.S. PATENT DOCUMENTS

| | | | |
|---|---|---|---|
| 1,713,507 | 5/1929 | Ammon | 241/73 |
| 2,141,664 | 12/1938 | Ossing | 241/46 A UX |
| 2,314,723 | 3/1943 | Mankoff | 241/194 |
| 2,505,674 | 4/1950 | Knight | 241/46 A UX |
| 3,170,640 | 2/1965 | Kolts et al. | 241/189 R X |
| 3,482,788 | 12/1969 | Newell | 241/189 R X |
| 3,708,129 | 1/1973 | Nowak | 241/189 R |
| 3,917,179 | 11/1975 | Graf | 241/194 |

*Primary Examiner*—Howard N. Goldberg
*Attorney, Agent, or Firm*—B. J. Powell

[57] ABSTRACT

A garbage disposal unit including a frame mounting a drive motor and a garbage disposal. The garbage disposal has a separable housing which mounts a hammer assembly over a perforated screen assembly. The housing has a cylindrical annular side wall closed at opposite ends by removable end plates to define a grinding chamber. The screen assembly slides into the bottom of the grinding chamber between breaker bars carried by the annular side wall and is retained in position by the end walls to separate the grinding chamber inlet from the outlet. The holes through the screen plate of the screen assembly cooperate with the hammers on the hammer assembly to comminute the garbage as the hammers are rotated thereby. The holes are staggered to maximize the comminution cooperation between the hammer assembly and the screen assembly with the hammers being staggered axially and circumferentially so that the hammers rotate in separate cutting planes axially spaced from each other.

7 Claims, 6 Drawing Figures

GARBAGE DISPOSAL

CROSS-REFERENCE TO RELATED APPLICATIONS

This application is a continuation-in-part of my copending application Ser. No. 716,582, filed Aug. 23, 1976 for "Solid Material Comminuting Method and Apparatus", now abandoned.

BACKGROUND OF THE INVENTION

Many garbage disposals are available on the market today. The principal type of garbage disposal available today uses a circular disk rotatable about a vertical axis in a cylindrical grinding chamber defined in the unit housing, also oriented along a vertical axis. The disk may carry centrifugally operated hammers which cooperate with stationary blades or projections carried in the grinding chamber to comminute garbage dropped onto the top of the circular disk with the comminuted garbage passing into the conventional sewer system between the periphery of the circular disk and the unit housing. This type of garbage disposal has a number of problems and disadvantages associated therewith. One problem is that thin sheet material can pass around the periphery of the circular disk and into the sewer system without being comminuted and frequently causes blockage of the sewer system. It is further difficult for this garbage disposal to comminute thin sheet material, especially when it is elastic, such as animal skin thereby frequently requiring removal of the garbage from the grinding chamber which the disposal will not comminute. Another problem associated with this type garbage disposal is that the drive shaft for the circular disk must extend out the bottom of the grinding chamber and thus creates sealing problems about this shaft. Further this type of garbage disposal usually mounts the drive motor in the housing directly on the drive shaft of the circular disk. This not only makes it difficult to gain access to the drive motor to repair or replace same but also transmits a large portion of the shocks on the circular disk directly to the drive motor shaft.

Attempts have also been made to use a hammer mill principle of operation in a garbage disposal, however, his type of disposal has not enjoyed widespread use because of a number of problems and disadvantages. One of the problems is that the construction cost of this type unit has been sufficiently high that this type unit has not enjoyed economic success. Further, this type unit usually does not possess the ability to handle the wide variety of materials in the garbage presented to it. Another problem is that this type unit is difficult to disassemble for repair.

SUMMARY OF THE INVENTION

These and other problems and disadvantages associated with the prior art garbage disposals are overcome by the invention disclosed herein by providing a garbage disposal using the hammer mill principle which is able to handle the wide variety of materials in garbage presented to it, which is able to insure complete communition of all of the garbage, which can be economically built and maintained, and which isolates the shocks on the hammer assembly from the drive motor. Those parts subject to the most wear can be reversed to provide new cutting surfaces without part replacement. The disposal is easily disassembled by relatively unskilled personnel for easy maintenance and repair.

That embodiment of the apparatus illustrated includes a frame mounting a drive motor and a garbage disposal. The garbage disposal has a separable housing which mounts a hammer assembly over a perforated screen assembly. The housing has a cylindrical annular side wall closed at opposite ends by removable end plates to define a grinding chamber. The screen assembly slides into the bottom of the grinding chamber between breaker bars carried by the annular side wall and is retained in position by the end walls to separate the grinding chamber inlet from the outlet. The holes through the screen plate of the screen assembly cooperate with the hammers on the hammer assembly to comminute the garbage as the hammers are rotated thereby. The holes are staggered to maximize the comminution cooperation between the hammer assembly and the screen assembly with the hammers being staggered axially and circumferentially so that the hammers rotate in separate cutting planes axially spaced from each other.

These and other features and advantages of the invention disclosed herein will become more apparent on consideration of the following drawings and description wherein like characters of reference designate corresponding parts throughout the various views and in which:

These figures and the following detailed description disclose specific embodiments of the invention, however, it is to be understood that the inventive concept is not limited thereto since it may be embodied in other forms.

DETAILED DESCRIPTION OF ILLUSTRATIVE EMBODIMENTS

Figure 1:
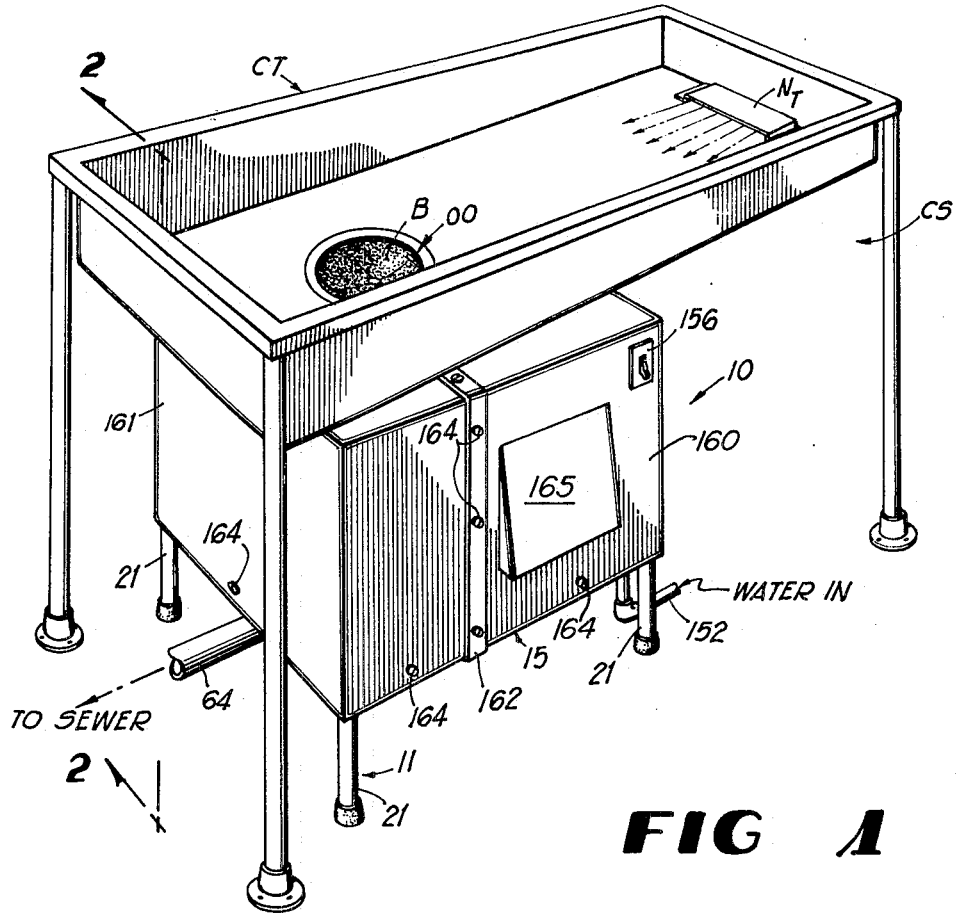
FIG. 1 is a perspective view of one embodiment of the invention installed.
Figure 2:
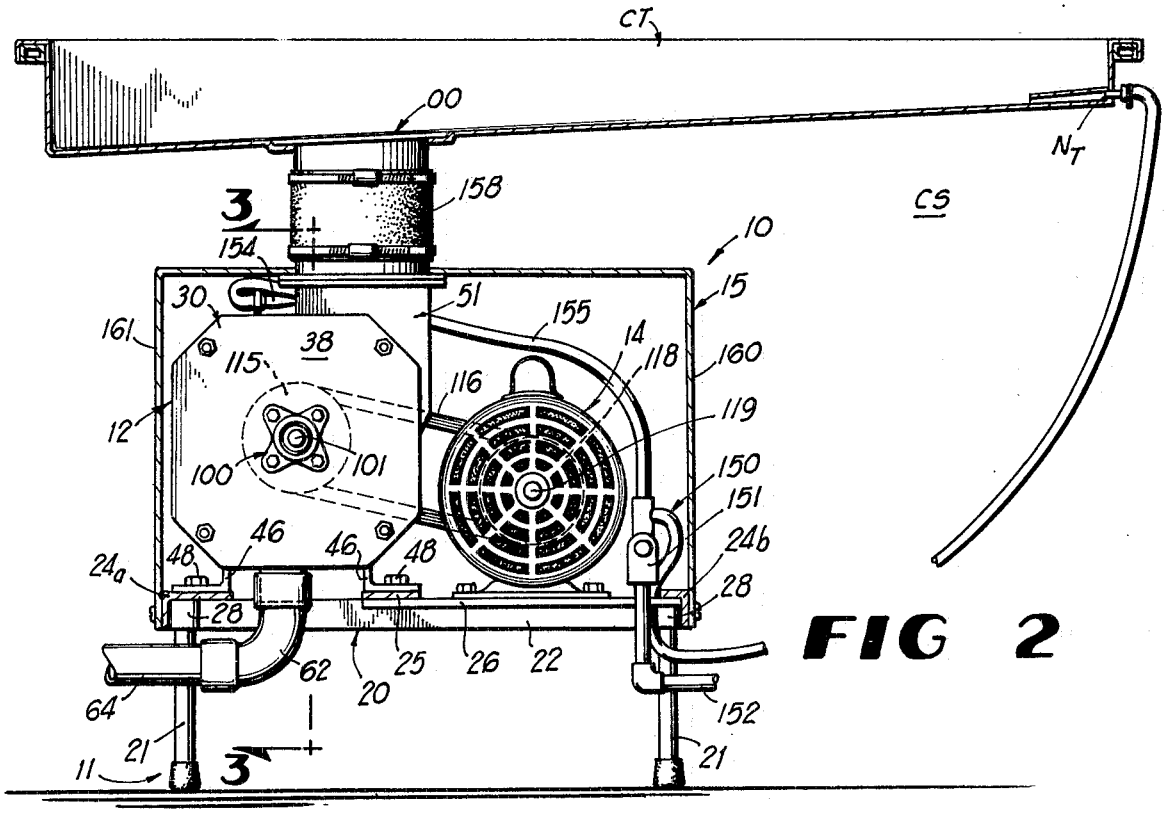
FIG. 2 is an enlarged cross-sectional view taken generally along line 2—2 in FIG. 1.

Referring generally to FIGS. 1 and 2, it will be seen that the invention is embodied in a garbage disposal unit 10 which is connected to the conventional outlet opening 00 in a sink or cleaning table CT normally found in the kitchen of a commercial food establishment or home. These sinks or cleaning tables usually have a sufficient clearance space CS thereunder to connect the disposal unit 10 without modification. The garbage disposal unit 10 includes generally a frame 11 which mounts a garbage disposal 12 and a drive motor 14 for the garbage disposal 12 thereon, and a cover 15 enclosing the frame 11, disposal 12 and drive motor 14. The garbage disposal unit 10 is adapted to comminute a wide variety of different materials in garbage, especially that normally associated with commercial food establishments which frequently includes plastic and paper plates, cups, straws, napkins, and other utensils as well as the usual food scraps and bones.

The frame 11 best seen in FIG. 2 includes a generally rectilinear base 20 supported by legs 21 at its corners. The base 20 has spaced apart, parallel side angles 22 joined at opposite ends by a pair of end angles 24a and 24b. An intermediate support strip 25 extends between side angles 22 generally parallel to the end angle 24a and is spaced inwardly of the end angle 24a to mount the disposal 12 between the end angle 24a and the intermediate strip 25 so that the drain from the disposal 12 can pass between the strip 25 and end angle 24a as will become more apparent. A motor support plate 26 extends between the intermediate strip 25 and the other end angle 24b as seen in FIG. 2 to adjustably mount the drive motor 14 thereon. Legs 21 control the height of base 20 above the floor and are removably connected to base 20 by threaded couplings 28 so that the legs 21 can be removed for length adjustment.

Figure 3:
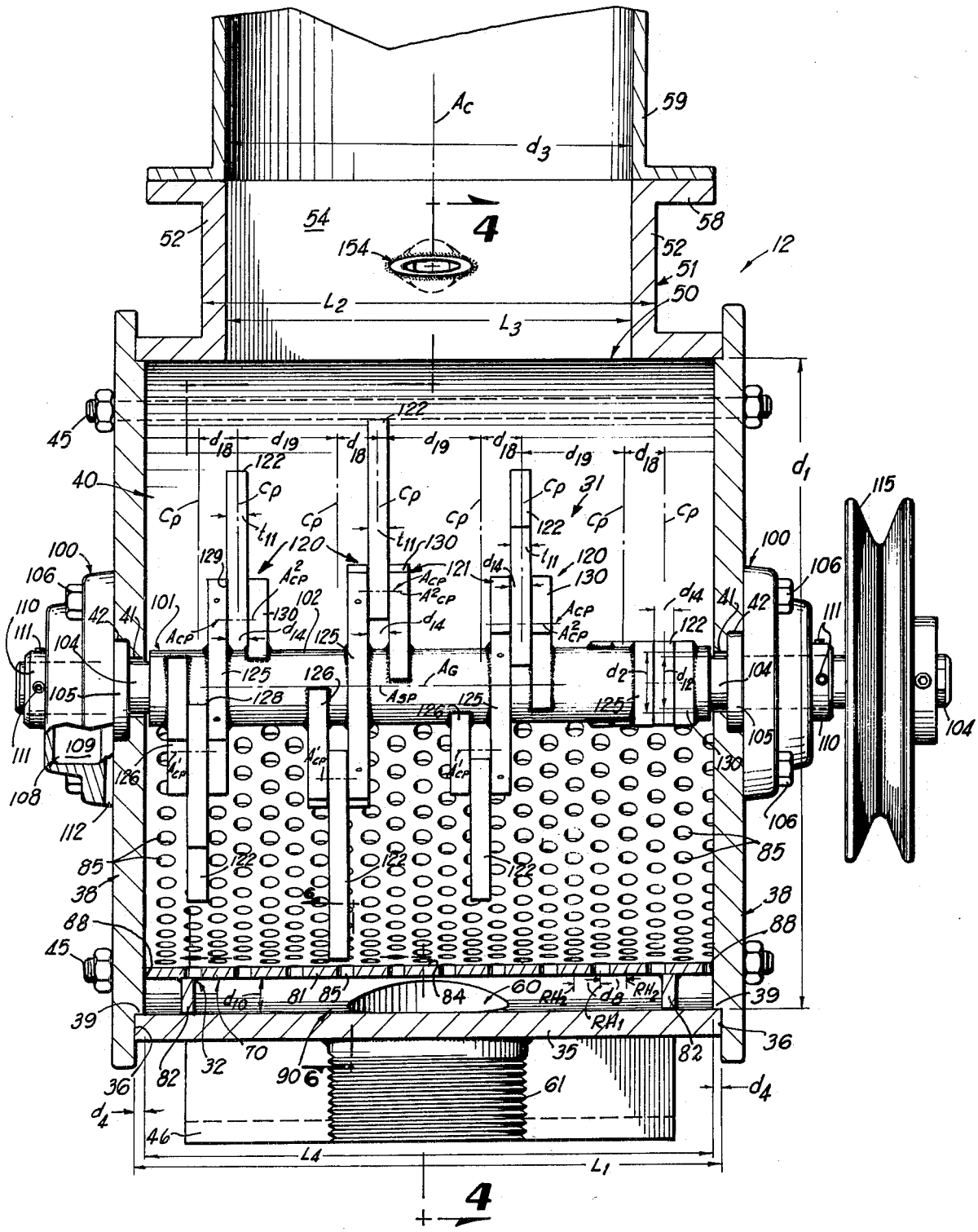
FIG. 3 is an enlarged cross-sectional view of the disposal unit of the invention taken generally along line 3—3 in FIG. 2.

The disposal 12 as best seen in FIGS. 2-5 includes a housing assembly 30, a hammer assembly 31, and a screen assembly 32. The housing assembly 30 includes an annualar cylindrical main body side wall 35 with an inside diameter $d_1$ (FIG. 4), central axis $A_G$ (FIG. 3 and 5) and length $L_1$ (FIG. 3). The opposite annular end surfaces 36 are normal to the axis $A_G$. The opposite ends of the side wall 35 are closed by a pair of end plates 38. Each of the end plates 38 are larger than the side wall inside diameter $d_1$ and is provided with a circular boss 39 on the inside thereof with diameter $d_1$ so that the boss 39 fits inside the end of the side wall 35 to locate each of the end plates 38 on side wall 35 and, in conjunction with the inside edge of each end plate 38 around boss 39, seal the opposite ends of the side wall 35 to form a cylindrical grinding chamber 40 with the central axis $A_G$. Each of the end plates 38 defines a shaft passage 41 therethrough centrally of boss 39 and concentrically about the grinding axis $A_G$ when the end plates 38 are in place as seen in FIG. 3. The shaft passages 41 have diameter $d_2$ as will become more apparent. A shaft seal counterbore 42 is provided in each end plate 38 at shaft passage 41 that opens onto the outside of end plate 38 and is concentric about axis $A_G$ when plates 38 are in position. While the peripheral shape of the end plates 38 may be varied, they are illustrated as octagonal with appropriate bolt holes 44 therethrough outboard of the side wall 35 so that tie bolts 45 seen in FIG. 4 and 5 can be inserted to clamp the end plates 38 onto opposite ends of the side wall 35. The bosses 39 project into the inside of side wall 35 the distance $d_4$ (FIG. 3).

Figure 4:
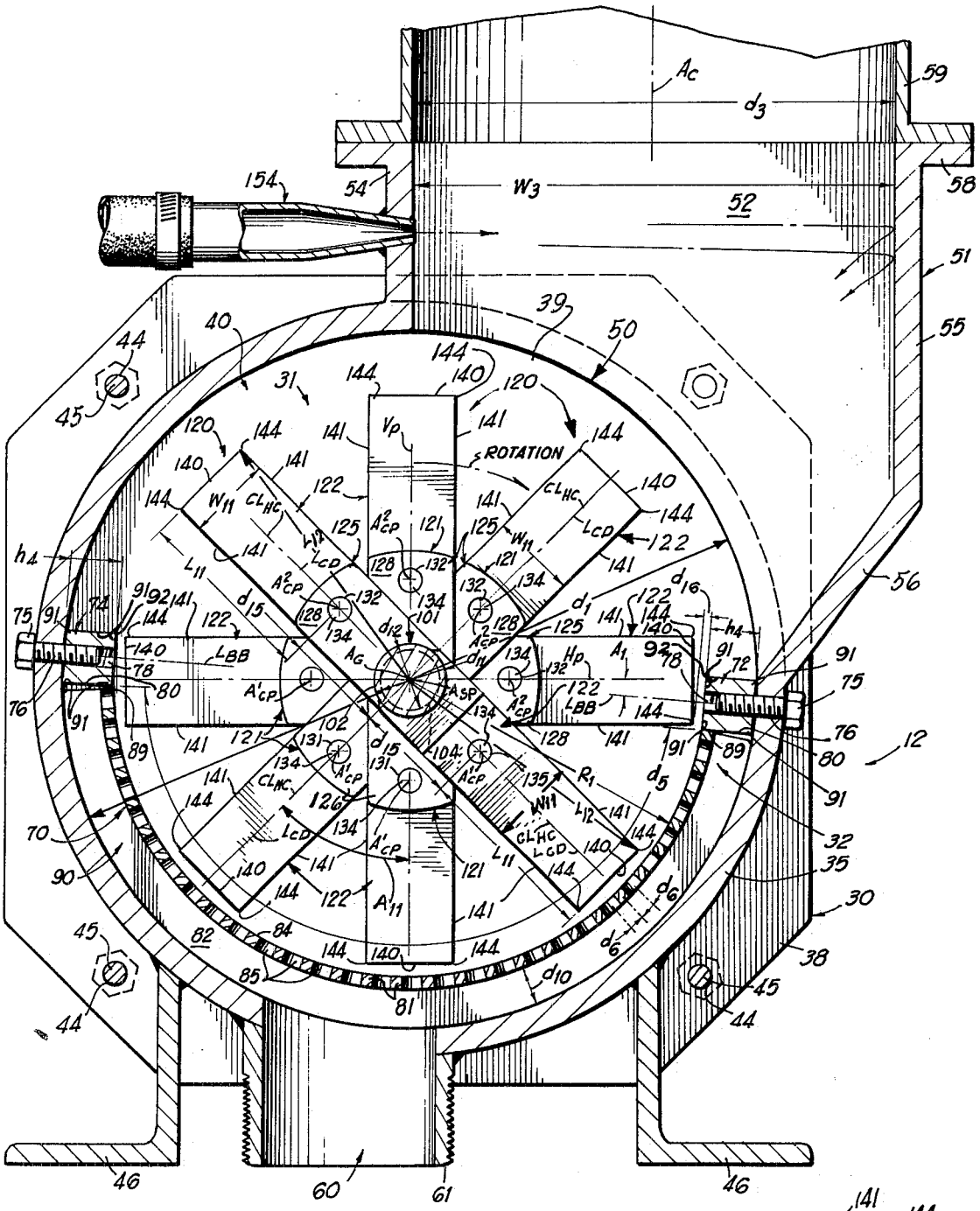
FIG. 4 is a cross-sectional view taken generally along line 4—4 in FIG. 3.

The housing assembly 30 is provided with a pair of L-shaped support pads 46 attached to the lower section of side wall 35 with appropriate bolt holes to receive hold down bolts 48 (FIG. 2) therethrough to mount the disposal 12 between the end angle 24a and the support strip 25 so that the grind axis $A_G$ is generally horizontal. This fixes the grinding chamber 40 so that it has a vertical plane VP diametrically extending therethrough and intersecting the grind axis $A_G$ and a horizontal plane HP diametrically extending therethrough and intersecting the axis $A_G$ as seen in FIG. 4. An inlet opening 50 is provided through the side wall 35 in the upper right hand quadrant as seen in FIG. 4. The inlet opening 50 extends from about the upper point intersection of the vertical plane VP clockwise as seen in FIG. 4 for about 90° around to about the right hand point of intersection of the horizontal plane HP with side wall 35, is centered along the length of side wall 35, and has an opening length $L_2$ (FIG. 3) less than the length $L_1$ of side wall 35. An upstanding feed chute 51 fits in the opening 50 in side wall 35 and is conventionally attached to side wall 35 about opening 50 such as by welding. It will be noted that the chute 51 has a generally square cross-sectional shape with a pair of chute side walls 52, an inboard chute end wall 54 and an outboard chute end wall 55 connected together. The lower ends of the chute side walls 52 are arcuate to match the shape of the annular side wall 35 along the opening 50. It will be noted that the inside of the inboard end wall 54 is generally aligned with the vertical plane VP and that the chute 51 has a length $L_3$ (FIG. 3) and a width $W_3$ where width $W_3$ is greater than the radius of the annular main body side wall 35. The feed chute 51 thus projects outboard of the side wall 35 and is connected to that edge of the opening 50 generally along the horizontal plane HP by a sloping feed wall 56 that angles inwardly and downwardly from the bottom of the outboard end wall 55 to the annular side wall 35 between the chute side walls 52. The top edge of the feed chute 51 is generally horizontal with a generally square top plate 58 (FIG. 4) connected to walls 52, 54 and 55. The top plate 58 has a hole therethrough which mounts a vertically oriented connector tube 59 thereon about the hole in plate 58. The connector tube 59 has an inside diameter $d_3$ about equal to the length $L_3$ and width $W_3$ of the inside chute 51 so that the vertical chute axis $A_C$ is offset from the grinding axis $A_G$ as seen in FIG. 4.

The bottom of the main body side wall 35 has a discharge opening 60 (FIG. 4) therethrough around which is attached a discharge pipe nipple 61 for connection to the conventional sewer drain via an elbow 62 and drain pipe 64 as seen in FIG. 2. Thus, it will be seen that the uncomminuted garbage is dropped into the grinding chamber 40 through the feed chute 51 where it is comminuted and then passed out through the discharge opening 60 to the sewer drain.

The screen assembly 32 includes an arcuate screen plate unit 70 along with a leading locating breaker bar 72 and a trailing locating breaker bar 74. The breaker bars 72 and 74 are removably attached to the inside of the main body side wall 35 and serve to locate the screen plate unit 70 therebetween as will become more apparent. The breaker bars 72 and 74 have the same square cross-sectional shape (FIG. 4) and a length substantially equal to the inside length $L_4$ (FIG. 3) of the grinding chamber 40. The bars 72 and 74 are removably attached to side wall 35 by threaded bolts 75 (FIG. 4 and 5) which extend through appropriate holes 76 (FIG. 5) in side wall 35 and threadedly engaged tapped holes 78 (FIG. 5) in the bars 72 and 74. The holes 76 in side wall 35 and tapped holes 78 in breaker bars 72 and 74 are located so that the breaker bars 72 and 74 are located in the grinding chamber 40 parallel to the grinding axis $A_G$ and centered along the length of the side wall 35 as will become more apparent. The holes 76 for the leading breaker bar 72 are diametrically opposed to the holes 76 for the trailing breaker bar 74 as best seen in FIG. 4. The spacing between the hole 76 in side wall 35 and the tapped holes 78 in breaker bars 72 and 74 is such that the bars 72 and 74 can be reversed in each position and with each other as will become more apparent. The common diametrical line $L_{BB}$ on which the bars 72 and 74 are centered is shifted clockwise from the horizontal plane HP the angle $A_1$ seen in FIG. 4 about 4° as will become more apparent. This separates the lower surfaces 80 of the breaker bars 72 and 74 the distance $d_5$ (FIG. 4) between which is carried the screen plate unit 70 as will become more apparent.

Figure 5:
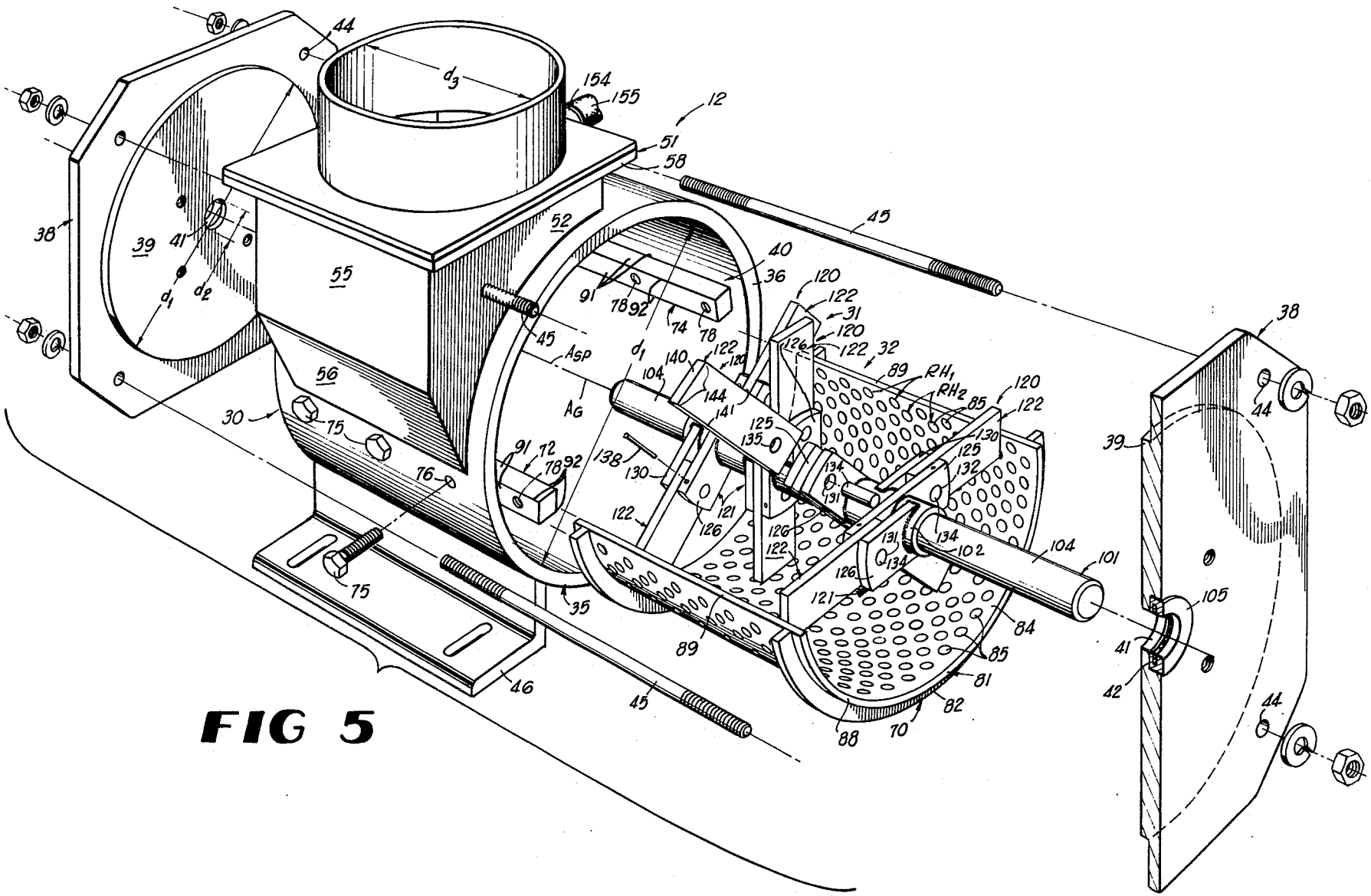
FIG. 5 is reduced partly exploded perspective view of the disposal unit of FIGS. 3 and 4.

The screen plate unit 70 includes an arcuate perforated screen plate 81 with spacer ribs 82 thereon to locate the plate 81. Plate 81 is thin (about ⅛ inch) with an inside radius of curvature $R_1$ (FIG. 4) less than the inside radius of side wall 35 as will become more apparent so that the inside surface 84 thereof is semi-cylindrical. A plurality of grinding holes 85 are defined through the screen plate 81 and are arranged in alternating, circumferentially extending rows $RH_1$ and $RH_2$ as best seen in FIGS. 4 and 5. The holes 85 in each row $RH_1$ and $RH_2$ are circumferentially spaced apart a distance $d_6$ (FIG. 4) center-to-center within each row with the rows $RH_1$ and $RH_2$ axially spaced apart a distance $d_8$ (FIG. 3) center-to-center. The holes 85 in rows $RH_2$ are circumferentially shifted one half the hole spacing distance $d_6$ with respect to the holes 85 in rows $RH_1$ (FIGS. 3, 5 and 6) so that the center-to-center distance between any two adjacent holes 85 regardless of the particular row is the distance $d_6$. The holes 85 all have the same diameter $d_9$ (FIG. 6) illustrated at about 0.250 inch. Each of the holes 85 also forms a sharp corner 86 (FIG. 6) at their juncture with the inside surface 84.

The spacer ribs 82 are relatively narrow and are attached to the outside peripheral surface of the screen plate 81 so that the ribs 82 extend circumferentially along the plate 81 parallel to each other and in planes generally normal to the axis of curvature $A_{SP}$ (FIGS. 3 and 5) of plate 81. The ribs 82 are located adjacent opposite sides of the plate 81. The arcuate side surfaces 88 (FIGS. 3 and 5) of the plate 81 also lie in planes normal to the axis of curvature $A_{SP}$ as seen in FIG. 3. The opposite end surfaces 89 (FIG. 4) of the screen plate 81 are generally parallel to the axis of curvature $A_{SP}$ so that the screen plate 81 and spacer ribs 82 have a circumferential length about equal to distance $d_5$.

The screen plate unit 70 slides into the bottom of grinding chamber 40 under the breaker bars 72 and 74 when one of the end plates 38 is removed as illustrated in FIG. 5. The spacer ribs 82 space the screen plate 81 circumferentially inboard of the main body side wall 35 the distance $d_{10}$ (FIG. 3) to define a discharge subchamber 90 between the screen plate 81 and the main body side wall 35 so that ground garbage passing through the holes 85 in screen plate 81 can pass along the discharge subchamber 90 and then out through discharge opening 60 in side wall 35 into the sewer drain through drain pipe 64. It will further be seen that the spacer ribs 82 locate the screen plate 81 so that its axis of curvature $A_{SP}$ coincides with the grinding axis $A_G$. Further, the axial length of the screen plate 81 is substantially equal to the inside length $L_4$ (FIG. 3) of the grinding chamber 40 so that the screen plate 81 separates the inlet opening 50 from the discharge opening 60. The circumferential length of the screen plate 81 is substantially equal to the circumferential distance $d_5$ (FIG. 4) between the breaker bars 72 and 74 so that opposite end surfaces 89 on screen plate 81 are in juxtaposition with the lower surfaces 80 on breaker bars 72 and 74 to close the opposite ends of discharge subchamber 90. The cross sectional height $h_4$ (FIG. 4) of breaker bars 72 and 74 is substantially equal to the height $d_{10}$ of spacer ribs 82 plus the thickness of screen plate 81 so that the inboard surfaces 91 of breaker bars 72 and 74 are approximately flush with the inside surface 84 of screen plate 81. The corners 92 of the breaker bars 72 and 74 are sharp as seen in FIG. 4 as will become more apparent.

The hammer assembly 31 as seen in FIGS. 3–6 is rotatably mounted on the end plates 38 of housing assembly 30 by a pair of bearing blocks 100 (FIG. 3) on the outsides of end plates 38 so that the hammer assembly 31 is rotatable about the grinding axis $A_G$. The hammer assembly 31 includes a mounting shaft 101 which extends through the shaft passages 41 and shaft seal counterbores 42 in the end plates 38 where it is journalled in the bearing blocks 100 as seen in FIG. 3. The shaft 101 has a central section 102 of diameter $d_{11}$ (FIG. 4) which is larger than the shaft passage diameter $d_2$ (FIG. 3). The section 102 has a length slightly less than the grinding chamber length $L_4$ to clear end plates 38. The shaft 101 has shaft end sections 104 of diameter $d_{12}$ (FIGS. 3 and 4) which is slightly less than shaft passage diameter $d_2$ to clear end plates 38. The end sections 104 extend out through the shaft passages 41 and shaft seal counterbores 42 in the end plates 38 and shaft seals 105 (FIG. 3) are press fitted in the counterbores 42 around the shaft end sections 104 to seal the grinding chamber 40 about opposite ends of the shaft 101. The bearing blocks 100 are held in place by bolts 106 (FIG. 3) which are threaded in end plates 38. Each of the bearing blocks 100 carry a bearing 108 (FIG. 3) therein with an outer race 109 fixed by bearing block 100 and an inner race 110 fixed to the end section 104 of shaft 101 by set screws 111 (FIG. 3). Thus, the bearings 108 and bearing blocks 100 axially fix the shaft 101 in grinding chamber 40 for rotation about the grind axis $A_G$. In the event of failure of the shaft seals 105, drain passage 112 (FIG. 3) is provided through the bottom of each bearing block 100 so that any liquid escaping from grinding chamber 40 about the end sections 104 on the shaft 101 will drain through passages 112 without passing through bearing 108 to cause damage thereto.

One of the end sections 104 of shaft 101 (the right hand one in FIG. 3) extends through the bearing block 100 sufficiently to mount a pulley 115 thereon. The pulley 115 is connected by a belt 116 to a similar pulley 118 mounted on the motor drive shaft 119 of motor 14 as seen in FIG. 2. The motor 14 rotates the mounting shaft 101 clockwise as seen in FIG. 4.

A plurality of hammer units 120 (FIGS. 3–5) are mounted on mounting shaft 101 at axially spaced positions for rotation with the mounting shaft 101 about the grind axis $A_G$ in axially spaced cutting planes CP (FIG. 3) normal to the grind axis $A_G$. Each hammer unit 120 includes a mounting clevis assembly 121 (FIGS. 3 and 4) fixed to shaft 101 which in turn rotatably mounts a pair of hammer cutters 122 (FIGS. 3–5) which are diametrically opposed when viewed as in FIG. 4 but axially displaced when viewed as in FIG. 3 as will become more apparent.

Each mounting clevis assembly 121 has a central clevis plate 125 (FIGS. 3–5) centered about the central section 102 of shaft 101 and attached to shaft 101 such as by welding. The longitudinal axis of the central clevis plate 125 is both normal to axis $A_G$ (FIG. 3) and diametrically extending with respect to shaft 101 (FIG. 4) along line $L_{CD}$. One side clevis plate 126 (FIGS. 3 and 4) extends diametrically outward from one side of shaft 101 parallel to and axially spaced from one side surface 128 (FIG. 3) of the central clevis plate 125 a distance $d_{14}$ (FIG. 3). The side clevis plate 126 is in angular registration with the central clevis plate 125 as seen in FIG. 4. Another side clevis plate 130 (FIGS. 3 and 4) extends diametrically outward from the opposite side of shaft 101 parallel to and axially spaced from the opposite side surface 129 (FIG. 3) of the central clevis plate 125 the distance $d_{14}$ (FIG. 3). The side clevis plate 130 is also in angular registration with the central devis plate 125 as seen in FIG. 4. The projecting end of the side clevis plate 126 and the projecting end of central clevis plate 125 in registration therewith define aligned pin mounting holes 131 (FIG. 4) therethrough concentric about a common pin axis $A_{CP}^1$ (FIGS. 3 and 4) parallel to the grind axis $A_G$ and spaced radially outward therefrom a distance $d_{15}$ (FIG. 4). The projecting end of the side clevis plate 130 and the projecting end of central clevis plate 125 in registration therewith define aligned pin mounting holes 132 (FIG. 4) therethrough concentric about a common pin axis $A_{CP}^2$ parallel to the grind axis $A_G$ and spaced radially outward therefrom distance $d_{15}$. Thus, it will be seen that the holes 131 in clevis plates 125 and 126 are diametrically opposed to holes 132 in clevis plates 125 and 130, centered on line $L_{CD}$ and both are equadistant from grind axis $A_G$.

A pivot pin 134 (FIGS. 4 and 5) carried in holes 131 in clevis plates 125 and 126 rotatably mounts one of the hammer cutters 122 through pivot hole 135 (FIGS. 4 and 5) in its inboard end between the clevis plates 125 and 126 and a similar pivot pin 134 carried in holes 132 in clevis plates 125 and 126 rotatably mounts another of the hammer cutters 122 through its pivot hole 135 between the clevis plates 125 and 126 in each mounting clevis assembly 121. Centrifugal force keeps the hammer cutters 122 extended so that their longitudinal axes lie along the line $L_{CD}$ as seen in FIG. 4 but the hammer cutters 122 can pivot about pins 134 if the hammer cutters strike a hard object to prevent severe damage to the disposal 12. Each of the pivot pins 134 are hardened steel to give a long service life and are held in place by a rolled pin 138 (FIG. 5) through the central clevis plate 125 and pin 134.

Each of the hammer cutters 122 is a generally rectilinear hardened steel plate with an effective length $L_{11}$ (about 2.125 inch) from its pin axis $A_{CP}$ as seen in FIG. 4; a width $W_{11}$ (about 1 inch) (FIG. 4) and a thickness $t_{11}$ (about 0.250 inch) (FIG. 3). The projecting end surface 140 of cutter 122 is generally normal to the cutter longitudinal centerline $CL_{HC}$ (FIGS. 4 and 6) while opposite side edge surfaces 141 are generally parallel to centerline $CL_{HC}$ so that the projecting corners 144 (FIGS. 4 and 6) of the cutter 122 is a sharp right angle corner as will become more apparent. When the cutter centerline $CL_{HC}$ is in registration with line $L_{CD}$ as seen in FIG. 4, the effective length $L_{12}$ from the grind axis $A_G$ to each corner 144 is just sufficient to provide a slight clearance distance $d_{16}$ (FIGS. 4 and 6) between the corners 144 and the inside surface 84 of the screen plate 81. While distance $d_{16}$ may be varied, 0.063 inch works satisfactorily.

From FIG. 3, it will be seen that each hammer cutter 122 rotates in a separate cutting plane CP. The cutting planes CP associated with each pair of hammer cutters 122 carried by each clevis assembly 121 are axially spaced apart a distance $d_{18}$ (FIG. 3) while the closest cutters 122 in different clevis assemblies 121 are axially spaced apart a distance $d_{19}$ (FIG. 3). While different distances $d_{18}$ and $d_{19}$ may be used, a distance $d_{18}$ of about 0.50 inch and a distance $d_{19}$ of about 1.250 inch have been found satisfactory. The axial distance $d_{18}$ should be such that the opening made through the garbage in grinding chamber 40 by the passage of one of the cutters 122 on each clevis assembly 121 will be filled by the other cutter 122 on the clevis assembly 121 before the first cutter 122 again passes through the garbage. The axial spacing $d_{19}$ between the different clevis assemblies 121 should be sufficiently great to prevent the garbage from being carried around in the chamber 40 by the cutters 122 without significant comminution thereof. The clevis assemblies 121 are each angularly offset from the other assemblies 121 as seen in FIG. 4 so that the diametricial line $L_{CD}$ of each clevis assembly 121 is angularly shifted with respect to that of the adjacent clevis assembly 121 by an angle $A_{11}$ shown at about 45° since there are four clevis assemblies 121. This serves to further insure comminution of the garbage.

Figure 6:
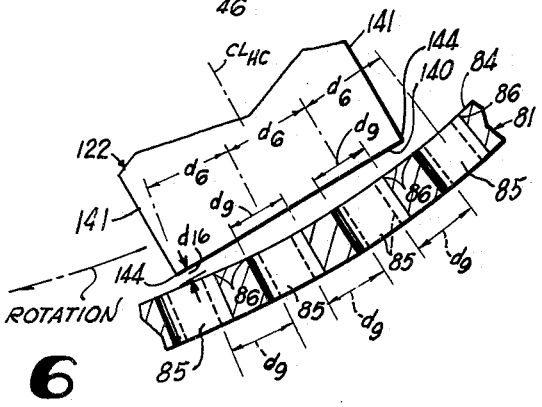
FIG. 6 is an enlarged partial cross-sectional view taken generally along line 6—6 in FIG. 3.

As the cutters 122 are rotated clockwise in grinding chamber 40 as seen in FIG. 4 by motor 14, the comminution of the garbage passing into chamber 40 through the feed chute 51 takes place in two stages. The first rough grinding stage occurs at the leading breaker bar 72 when the projecting ends of the cutters 122 pass thereby. This preliminarily breaks the garbage up into smaller chunks that then fall down onto the screen plate 81. The final grinding stage takes place between the screen plate 81 and cutters 122. As the leading corner 144 on each cutter 122 forces the partly comminuted garbage along the inside surface 84 on the screen plate 81, that portion of the sharp corners 86 between grinding holes 85 and screen surface 84 catches the garbage as seen in FIG. 6 to cause the corner 144 on cutter 122 to shear off small pieces of the garbage that then fall through the holes 85 into the discharge subchamber 90 to be washed into the sewer through the discharge opening 60 and drain pipe 64. Because the ends of the cutters 122 are square while screen plate 81 is curved, the cutting action takes place at corner 144 without binding or wedging.

Even though the cutters 122 and screen plate 81 are made of hardened steel, the cutting action on the garbage tends to wear the leading corner 144 of the cutters and that portion of the sharp corner 86 around grinding holes 85 which faces the oncoming cutters 122. When these corners 86 and 144 become sufficiently worn to reduce the garbage comminution efficiency of the disposal 12, one end plate 38 can be removed, the screen plate unit 70 axially slipped out of the grinding chamber 40, axially reversed, and then slipped back in chamber 40 under the breaker bars 72 and 74 to expose that portion of the sharp corners 86 on screen plate 81 opposite the worn portion to the oncoming cutters 122. Also, the rolled pins 138 can be removed from the clevis assemblies 121 to release the cutter pivot pins 134 for removal in order that the cutters 122 can be axially rotated 180° and the pivot pins 134 along with the rolled pins 138 replaced in the clevis assemblies 121 to expose the unworn corner 144 of cutter 122 to the garbage. It will also be noted that the upper inside corner 91 on the leading breaker bar 72 also wears. Not only can the breaker bar 72 be axially reversed by removing bolts 75, it can also be rotated about its axis to eventually expose all of the sharp corners 91 as the upper inside corner. Further, the leading and trailing breaker bars 72 and 74 can be swapped to provide four more corners.

Because the inlet opening 50 extends clockwise from the vertical plane VP as seen in FIG. 4, any garbage moved clockwise by hammer cutters 122 will pass into feed chute 51 tangential to the side wall 35 at plane VP and thus will not be thrown upwardly out of the feed chute 51. The sloping wall 56 in the bottom of feed chute 51 insures that the garbage will be fed into the grinding chamber 40 over the leading breaker bar 72.

To assist in both flushing the uncomminuted garbage into the disposal 12 and the comminuted garbage out of the disposal, a flushing liquid such as water is injected thereinto through a water control unit 150 (FIG. 2). The water control unit 150 includes a solenoid valve 151 (FIG. 2) having its inlet connected to a conventional pressurized water source through inlet pipe 152. The outlet of valve 151 is connected to an injection nozzle 154 in the feed chute 51 (FIGS. 2–4) via hose 155 so that when valve 151 is opened by closure of switch 156 (FIG. 1), water will be sprayed across the chute 51 as best seen in FIG. 4 to wash the garbage out of chute 51 into grinding chamber 40. The water then flows through the holes 85 in screen plate 81 to wash the comminuted garbage out of the discharge subchamber 90 into the sewer system via pipe 64.

The outlet of solenoid valve 151 is illustrated in FIG. 2 also connected to a table flush nozzle $N_T$(FIGS. 1 and 2) to flush the garbage out of the cleaning table CT through the rubber baffle B (FIG. 1) and the outlet opening 00 into the feed chute 51. The outlet 00 of table CT is connected to the feed chute connector tube 59 by a flexible hose 158 (FIG. 2). The switch 156 also starts motor 14. If sufficient water is available from other sources, the water control unit 150 may be omitted.

The cover 15 has two halves 160 and 161 (FIGS. 1 and 2) which overlap at 162 (FIG. 1) to enclose the motor 14 and garbage disposal 12 on frame 11. Screws 164 (FIG. 1) connect the halves together at the overlapped joint 162 and also attach the halves to the frame 11. An air inlet 165 is provided for motor 14. The bottom of frame 11 is left open for the passage of pipes 64 and 152 as seen in FIG. 2.

I claim:

1. A garbage disposal comprising:

a housing defining a generally cylindrical grinding chamber therein defining a central grinding axis therethrough, an inlet to said grinding chamber through which garbage can be introduced into said grinding chamber, and an outlet from said grinding chamber from which the comminuted garbage is discharged from said grinding chamber;

a hammer assembly rotatably mounted by said housing within said grinding chamber about a rotational axis coinciding with the grinding axis, said hammer assembly including a drive shaft assembly rotatable about the grinding axis and a plurality of hammer cutters pivotally mounted on said drive shaft assembly about cutter pivot axes generally parallel to and spaced outboard of the grinding axis, said hammer cutters rotated with said drive shaft assembly in cutting planes generally normal to the grinding axis, each of said hammer cutters rotating in a separate cutting plane axially spaced along said support shaft assembly from the cutting planes of the other of said hammer cutters, each of said hammer cutters having a longitudinal centerline, an outboard end surface opposite the pivotal connection between said hammer cutter and said drive shaft assembly oriented normal to the longitudinal centerline, and opposed leading and trailing side edge surfaces joining opposite ends of the end surface and defining outboard leading and trailing sharp corners at the junction of the end surface and side edge surfaces of said hammer cutter, each of said hammer cutters pivotal with respect to said drive shaft assembly about the cutter pivot axis so that the centrifugal force on said hammer cutter keeps it generally radial with respect to the grinding axis so that the outboard leading and trailing sharp corners of said hammer cutter is located a first prescribed radial distance from the grinding axis;

a screen assembly carried by said housing within said grinding chamber, separating said inlet from said outlet in said grinding chamber, and cooperating with said hammer assembly to comminute the garbage, said screen assembly including, an arcuate screen plate and screen positioning means for locating said screen plate in said grinding chamber, said arcuate screen plate defining a plurality of grinding holes therethrough of a diameter at least as small as the largest piece of comminuted garbage to pass from said outlet from said grinding chamber and further defining a sharp corner about each of said grinding holes at the inside surface of said screen plate, said screen plate having a prescribed inside radius slightly greater than said first prescribed radial distance of the sharp corners on said hammer cutter, said screen positioning means locating the inside surface of said screen plate so that its radius of curvature coincides with the grinding axis and the inside surface is concentric about the grinding axis, said screen positioning means further locating the inside surface of said screen plate sufficiently close to the sharp corners of said hammer cutters so that the leading sharp corner of each of said hammer cutters forces the garbage into the grinding holes in said screen plate and shears the garbage between the leading corner of said hammer cutter and the grinding holes in said screen plate to comminute the garbage and so that the outboard end surface of said hammer cutter allows the garbage to expand after passage of the leading corner of said hammer cutter while maintaining cutting contact of the garbage immediately outboard of the outboard end surface of said hammer cutter and the grinding holes in said screen plate to prevent wedging; and, a leading breaker bar mounted inside said grinding chamber at the leading end of said screen plate and longitudinally oriented generally parallel to the grinding axis, said leading breaker bar located to cooperate with said hammer cutter to preliminarily break large pieces of the garbage into smaller pieces so that these smaller pieces can be comminuted between said hammer cutters and said screen plate.

2. The garbage disposal of claim 1 wherein said housing includes an annular cylindrical side wall concentric about said grinding axis and defining opposite end surfaces thereon generally normal to said grinding axis, a pair of end plates removably positioned at opposite ends of said side wall to close same and define said grinding chamber therein, each of said end plates including an inwardly projecting cylindrical boss thereon sized for receipt inside said side wall to locate said end walls with respect to said side wall and to seal said end plates to said side wall, and holding means removably interconnecting said end plates to maintain said end plates in sealing engagement with said side wall; said screen assembly slidably mounted in said side wall and removably held in position by said bosses on said end plates, said screen assembly further being axially reversible in said side wall so that said screen assembly can be axially reversed to expose a different portion of the sharp corner about the grinding holes in said screen plate to grinding action with said hammer cutters; said housing further including an upstanding feed chute mounted on said side wall and defining a feed passage therethrough communicating with said grinding chamber through the inlet defined through said side wall.

3. The garbage disposal of claim 2 further including flush liquid supply means for directing a spray of wash liquid across said feed passage in said feed chute in a direction normal to the upstanding axis of said feed chute to maintain the spray of wash liquid substantially across said feed passage, said spray of wash liquid directed generally concurrent with the movement of said hammer cutters.

4. The garbage disposal of claim 3 wherein said shaft assembly includes a mounting shaft rotatably mounted in said housing about said grinding axis and a plurality of radially extending clevis assemblies attached to said mounting shaft at axially spaced apart positions; each of said clevis assemblies including a central clevis plate mounted at its center on said mounting shaft and projecting radially outwardly on opposite sides of said mounting shaft, a first side clevis plate mounted on said mounting shaft and projecting radially outwardly from said mounting shaft on one side of and in registration with one end of said central clevis plate and axially spaced therefrom, and a second side clevis plate mounted on said mounting shaft and projecting radially outward from said mounting shaft on that side of said central clevis plate opposite said first side clevis plate and in registration with that end of said central clevis plate opposite the one end in registration with said first side clevis plate and axially spaced from said central clevis plate, a plurality of pivot pins, one of said pivot pins pivotally mounting one of said hammer cutters between said central clevis plate and said first side clevis plate of each of said clevis assemblies about said cutter pivot axis, and another of said pivot pins pivotally mounting another of said hammer cutters between said central clevis plate and said second side clevis plate of each of said clevis assemblies about said cutter pivot axis; and a plurality of rolled pins, each of said rolled pins fixedly, yet removably, connecting one of said pivot pins to said central clevis plate of said clevis assembly associated with said pivot pin.

5. The garbage disposal of claim 4 wherein said grinding holes in said screen plate are arranged in axially spaced circumferentially extending rows lying in planes normal to the grinding axis, said grinding holes in each row circumferentially staggered with respect to said grinding holes in the rows adjacent thereto.

6. The garbage disposal of claim 5 wherein each of said grinding holes is equidistant from each grinding hole adjacent thereto.

7. The garbage disposal of claim 6 further including a trailing breaker bar mounted inside said grinding chamber on said side wall at a position circumferentially spaced from said leading breaker bar and at the trailing end of said screen assembly so that said screen assembly is slidably receivable in said grinding chamber between said leading and trailing breaker bars, said screen assembly being circumferentially fixed by said breaker bars, and axially fixed by said end plates.

* * * * *